United States Patent [19]

Rühle et al.

[11] Patent Number: 4,706,894

[45] Date of Patent: Nov. 17, 1987

[54] PROCESS OF PRODUCING A MECHANICALLY ALLOYED COMPOSITE POWDER

[75] Inventors: Manfred Rühle, Obertshausen; Peter Wincierz, Steinbach, both of Fed. Rep. of Germany

[73] Assignee: Metallgesellschaft Aktiengesellschaft, Frankfurt am Main, Fed. Rep. of Germany

[21] Appl. No.: 884,250

[22] Filed: Jul. 10, 1986

[30] Foreign Application Priority Data

Jul. 13, 1985 [DE] Fed. Rep. of Germany ..... 3525056

[51] Int. Cl.[4] ..... B02L 23/00

[52] U.S. Cl. ..... 241/30; 241/175

[58] Field of Search ..... 241/21, 30, 175

[56] References Cited

U.S. PATENT DOCUMENTS 3,529,780 9/1970 Wilkinson, Jr. ..... 241/175 X

FOREIGN PATENT DOCUMENTS 814453 3/1981 U.S.S.R. ..... 241/175

*Primary Examiner*—Timothy V. Eley

*Attorney, Agent, or Firm*—Sprung Horn Kramer & Woods

[57] ABSTRACT

In a process of producing mechanically alloyed composite powder, a mixture consisting of at least one metallic powder and at least one non-metallic powder or of a plurality of metallic powders is ground in a drum mill in which a large amount of energy is introduced into the material being ground. To obtain composite powders having reproducible properties for mechanical technology, the powders are ground in a centrifugal mill which has a cylindrical grinding drum, which rotates about its axis and revolves on an orbit about a stationary axis that is parallel to the axis of the drum. Said revolution is effected at an angular velocity that has a constant ratio to the angular velocity at which the drum rotates about its own axis.

3 Claims, No Drawings

PROCESS OF PRODUCING A MECHANICALLY ALLOYED COMPOSITE POWDER

BACKGROUND OF THE INVENTION

This invention relates to a process of producing a mechanically alloyed composite powder wherein a mixture of powders is prepared which consist of materials which in a liquid state are only partly soluble or are insoluble in each other, said mixture consists of at least one metallic powder and at least one non-metallic powder or consists of a plurality of different metallic powders, said mixture is ground in a drum mill in an operation in which a large quantity of energy is introduced into the mixture being ground, and the atmospheric and/or temperature conditions under which the mixture is ground are optionally controlled.

Mechanical alloying operations can be carried out to produce composite powders which comprise a metallic matrix in which very fine metallic or non-metallic particles are dispersed with a small particle spacing. The process has been used to produce alloys having components which in a molten state are not adequately soluble in each other and/or exhibit an undesired segregation as the mixture solidifies. During mechanical alloying operations, metallic powders and one or more components, such as a high-melting oxide powder or another metal powder, are ground in a drum mill, in which a large amount of energy is introduced into the material being ground. In that operation the powder particles are rolled out by the grinding elements to form thin foils or are disintegrated by said grinding elements and the thin foils are continually bonded by welding. Owing to the high energy supplied, an equilibrium between the bonding of the powder particles and their disintegration is soon achieved so that a composite powder having a uniform particle size and constituting a highly homogenous dispersion is usually obtained. The grinding operation results in the formation of identically composed, composite powder particles which in most cases are laminated. As the grinding operation proceeds, the thickness of the individual layers decreases and the number of layers in each powder particle gradually increases. Mechanical alloying operations may be carried out to alloy not only ductile metals with each other but also to introduce brittle and/or non-metallic components in a state of fine division into a metallic matrix. The grinding operation is performed in conventional ball mills or in attritors and with an optional control of the atmospheric and/or temperature conditions. A grinding operation resulting in a composite powder which is homogenized to the desired degree will take much longer in a grinding mill than in an attritor. But both grinding units are virtually unable to produce mechanically alloyed composite powder particles having reproducible properties for mechanical technology. Besides, the components of the above-mentioned grinding units are subjected to considerably wear.

SUMMARY OF THE INVENTION

It is an object of the present invention to teach how mechanically alloyed composite powders can be produced in a reproducible manner in a process in which a composite powder having a uniform composite can be produced within a shorter time and the wear of the components of the mill and of the grinding elements can be distinctly reduced.

That object is accomplished by the use of a centrifugal mill having a cylindrical grinding drum, which rotates about its own axis and simultaneously revolves on an orbit about a stationary axis of revolution, which is parallel to the axis of the grinding drum, at an angular velocity which has a constant ratio to the angular velocity at which the drum rotates about its own axis, and said drum is connected to drive means for rotating the grinding drum about its own axis and for causing the grinding drum to revolve on an orbit described by the axis of the grinding drum.

The center of said orbit is disposed within the cross-section of the grinding vessel, which does not rotate about its own axis.

Such centrifugal mill has been disclosed in Published German Application 26 31 826 and has no critical speed and contrary to the known mills described hereinbefore effects for the grinding operation an acceleration that is up to 30 times the acceleration that is due to gravity. As a result, a much higher energy density is obtained in the mill so that a much more compact structure can be adopted. Centrifugal mills have been used thus far to grind mineral raw materials and other products to a high fineness and to have large surface areas, owning to the high efficiency of the mill, and for a fine grinding of coal in suspensions of coal in water or coal in oil. In the latter use, desirable results are produced by the very strong mixing action which is due to the high cetrifugal forces which are effective. Because complicated gears and pinions are not provided, the wear is correspondingly reduced. In comparison with an attritor, the energy requirement is reduced by as much as 30%. Besides, the time of treatment is 95% shorter than the ball mills and more than 50% shorter than with attritors provided with stirrers. Because the orientation of the grinding drum in space is not changed, a direct or indirect cooling can be effected in a relatively simple manner.

The degree of filling usually amounts to 30 to 90% and the throughput rate usually amounts to 10 to 1500 kg/h.

The invention will be explained more in detail hereinafter with reference to an illustrative embodiment.

DETAILED DESCRIPTION OF THE INVENTION

The following commercially available powders were used as starting powders.

| | Particle size |
|---|---|
| NiCr 20 Al5 | 0.3 to 0.6 mm |
| NiCr 80 | 0.3 to 0.6 mm |
| Ni Ti 35 | <0.1 mm |
| $Ai_2O_3$ | about 0.06 μm |

The grinding elements consisted of steel balls having a total weight of 2.5 kg and a diameter of 10 mm. The material to be ground weighed 2.0 kg. The grinding vessel or drum had a volumetric capacity of 8 liters and was rotated at 450 revolutions per minute. The temperature measured in the cover of the grinding vessel rose to 100° to 130° C. within 15 minutes and thereafter remained constant as the grinding operation was continued for an additional 15 minutes. After the grinding operation, the sieves analysis revealed that 88% of the powder had a particle size belcw 0.5 mm. The powder particles had a hardness between VHN 782 and 888.

The layers of the several components were so thin that they could not be resolved by means of an optical microscope.

The high plastic deformation is of decisive importance for the composite powders which have been mechanically alloyed in the centrifugal mill and results in a formation of very hard powder particles. The composite powders can be compacted by extrusion and may subsequently be heat-treated, if desired.

What is desired is:

1. In a process of producing a mechanically alloyed composite power, including preparing a mixture of powders consisting of materials which are at most only partly soluble in each other when in a liquid state, said mixture consisting of at least one metallic powder and at least one non-metallic powder or a plurality of different metallic powders, and grinding said mixture in a drum mill by introducing a large quantity of energy into the mixture being ground, the improvement wherein the step of grinding comprises: grinding the mixture in a centrifugal mill having a cylindrical grinding drum, which rotates about its own axis and simultaneously revolves on an orbit about a stationary axis of revolution, which is parallel to the axis of the grinding drum and within the cross-section of the grinding drum, at an angular velocity which has a constant ratio to the angular velocity at which the drum rotates about its own axis, and driving the drum to rotate same about its own axis to cause the grinding drum to revolve in an orbit described by the axis of the grinding drum.

2. A process according to claim 1, wherein the degree of filling of the grinding drum is 30 to 90%.

3. A process according to claim 1 or 2, having a throughput rate which amounts to 10 to 1500 kg/h.

* * * * *